United States Patent [19]

Gracia

[11] Patent Number: 4,721,416

[45] Date of Patent: Jan. 26, 1988

[54] SUBMERSIBLE OFFSHORE DRILLING AND PRODUCTION PLATFORM JACKET

[75] Inventor: Eberto Gracia, Houston, Tex.

[73] Assignee: International Building Systems, Inc., Houston, Tex.

[21] Appl. No.: 940,935

[22] Filed: Dec. 12, 1986

[51] Int. Cl.[4] ..... E02B 17/00

[52] U.S. Cl. ..... 405/227; 405/225

[58] Field of Search ..... 405/228, 227, 203, 204, 405/195, 225, 226, 224

[56] References Cited

U.S. PATENT DOCUMENTS

| | | | |
|---|---|---|---|
| 2,927,435 | 3/1960 | Upson | 405/227 |
| 3,134,235 | 5/1964 | Parker et al. | 405/228 |
| 3,550,384 | 12/1970 | Bardgette et al. | 405/227 |
| 3,638,436 | 2/1972 | Pogonowski | 405/227 |
| 4,109,477 | 8/1978 | Vogel | 405/225 X |
| 4,422,805 | 12/1983 | Sweatman | 405/227 X |
| 4,576,523 | 3/1986 | Smetak | 405/227 |

*Primary Examiner*—Dennis L. Taylor

*Attorney, Agent, or Firm*—Jack W. Hayden

[57] ABSTRACT

A submersible offshore jacket assembly is provided having a plurality of elongated pilings with a first diameter. A plurality of spaced, longitudinally aligned sleeves of a diameter greater than the first diameter of the piling are interconnected by suitable bracing and receive a piling therethrough, so that the sleeves surround the piling and are spaced therealong separately one from the other. A plurality of braces are connected to one another and each of said sleeves in an arrangement whereby said sleeves with the pilings function as the legs of the assembly. Each of said pilings has an exterior surface area otherwise completely exposed to the environmental forces of tides, wind, waves and current, along substantially the entire length of each piling between the spaced sleeves.

1 Claim, 4 Drawing Figures

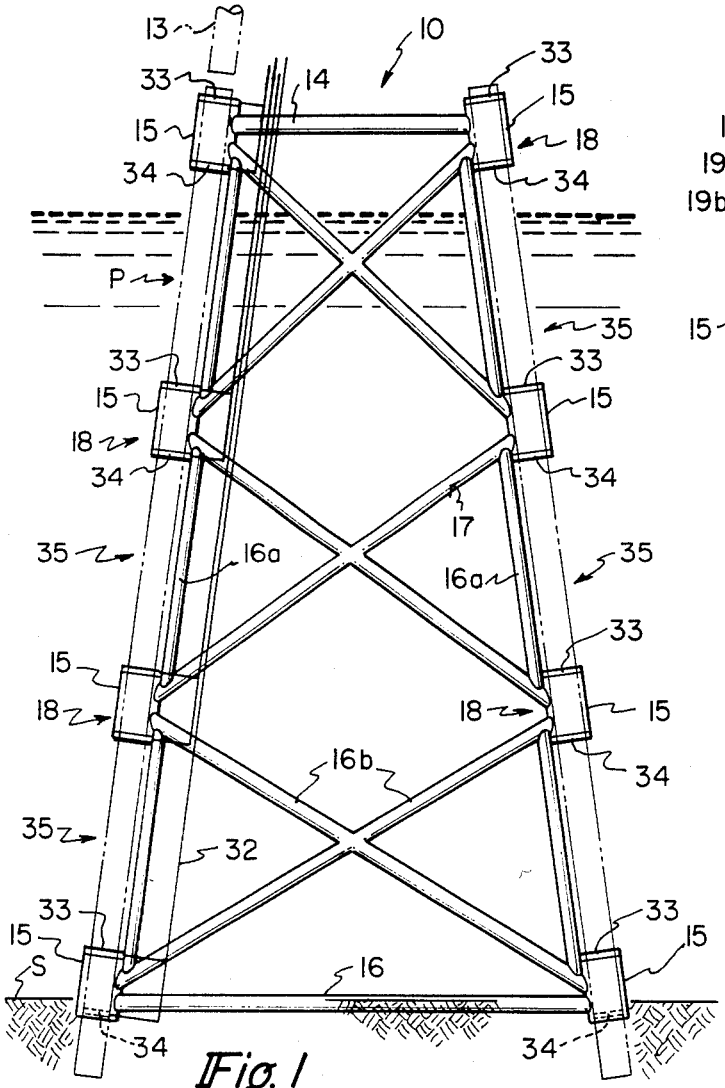
Fig. 1
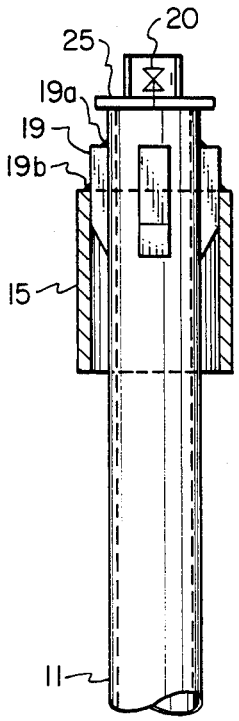
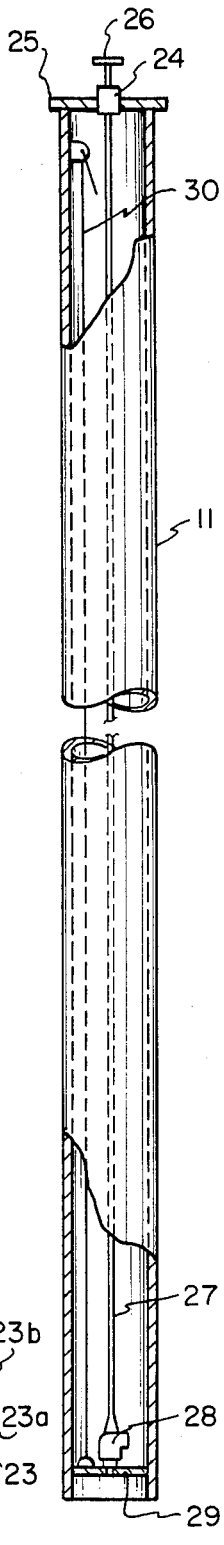
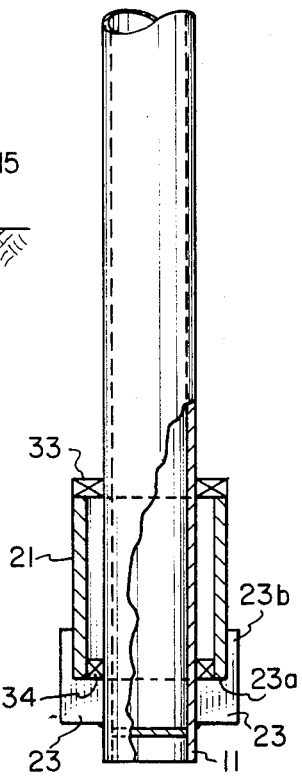
Fig. 2
Fig. 3
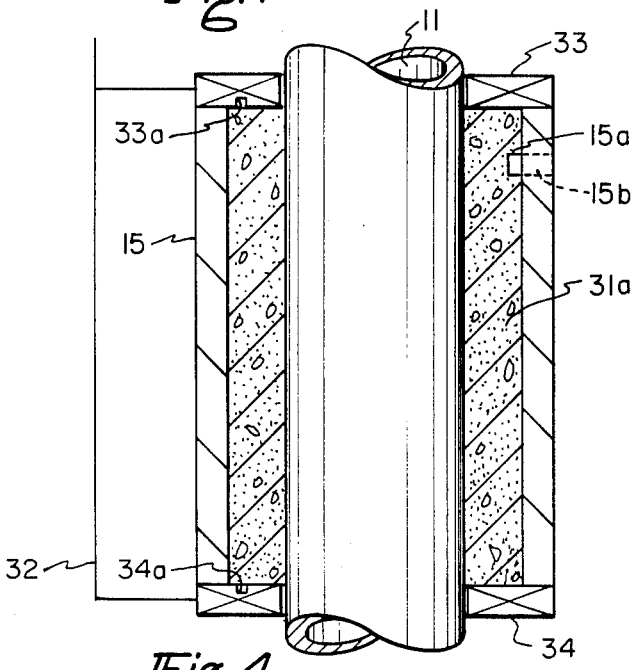
Fig. 4

SUBMERSIBLE OFFSHORE DRILLING AND PRODUCTION PLATFORM JACKET

BACKGROUND OF THE INVENTION

In a typical offshore drilling operation, a platform jacket or structure with any desired number of legs such as by way of example only, 4, 6, 8, 16, etc. is fabricated in a shipyard to form a structure and the structure is towed to an offshore location by a transport barge. At the location, the jacket is launched and set on the bottom by flooding the jacket legs thereby sinking the jacket to the marine floor. Once set, foundation piles are then driven through the jacket legs in order to stabilize the structure and grouting is placed between the longitudinally extending jacket leg and pile extending therethrough. The lower deck section is then set on top of the submerged structure, followed by the upper deck section, if one is desired. Such jackets are usually constructed of steel with legs of about 52 inches in diameter. As a result, the structure is of massive weight with massive surface areas of legs exposed to tide, wind, wave and current. Hence, the practicality of effective environmental stability of such structure may be reduced resulting in possible serious damage to the platform due to wind or wave action as well as damage due to the transport barges and tenders which bump the structure while coming alongside and docking thereto. Hence, a jacket of substantially less weight and with a reduced amount of exposed surface area which is subject to the tremendous forces of wind, wave, tides and current, conditions inherent in offshore operations, is sorely in need, Previous attempts to improve stability of such jackets has heretofore been futile due to the conditions in which such units are put into operation.

SUMMARY OF THE INVENTION

This invention relates to an offshore jacket assembly, or structure, and more particularly relates to a submersible jacket which possesses substantially less mass than prior offshore platform systems and includes a significantly smaller surface area at the exterior thereof for exposure to wind, waves, tide and current, than structures in the prior art.

The reduced weight and surface area of the jacket sleeves of the present invention render them of increased environmental stability which has heretofore been a drawback of existing prior art divices, and renders the device of the present invention better suited to mooring and anchoring.

The weight and surface area of the present invention have been reduced by means of a novel arrangement of jacket sleeves each of which is spaced apart one from the other along a piling extending through the aligned sleeves so that the smaller diameter piling is practically otherwise completely exposed between the aligned spaced sleeves, whereas previous prior art offshore structures include longitudinally extending jacket legs for substantially completely enclosing or housing the individual pilings. The present invention however relies upon much shorter and compact separate and spaced apart jacket sleeves which are interconnected and aligned by suitable bracing which add much less mass to the overall weight of the assembly. The result is that the jacket of the present invention weighs much less and the exposed piling possesses much less surface area on its exterior than heretofore known conventional jacket legs of devices of the prior art.

Thus, the invention relates specifically to a submersible offshore jacket assembly comprising a plurality of elongated pilings having a first diameter, a plurality of sleeves of a diameter greater than said first diameter and with the sleeves being longitudinally aligned and spaced in inter-connected relationship by suitable bracing whereby a piling extends through each group of longitudinally aligned sleeves so that the sleeves are in surrounding relationship to the piling at longitudinally spaced intervals therealong separately one from the other. The sleeves while being interconnected by a plurality of braces connected to one another and to each of adjacent spaced sleeves provides an arrangement or structure whereby said pilings function as the legs of the assembly, and wherein each of said pilings has an exterior surface area completely exposed to the environmental forces of tide, wind, waves and current, along substantially the entire length of each piling except where surrounded by the longitudinally aligned, spaced sleeves.

This invention also relates to a method of grouting an elongated piling of a submersible offshore jacket assembly to the support structure of the assembly comprising the steps of introducing grout into the interior of the support structure at longitudinally separate and spaced apart sleeve locations along the length of each piling of the assembly, and containing said grout within the spaced sleeves in order to allow it to set at each of said separate and spaced apart sleeve locations along the length of each of said pilings of the submersible offshore jacket assembly.

In a particularly specific embodiment of the present invention, the invention relates to a submersible offshore jacket assembly conprising a plurality of elongated pilings having a first diameter, a plurality of sleeves of a diameter greater than said first diamter and associated with each piling in surrounding relationship thereto and further spaced therealong separately one from the other, a plurality of braces connected to one another and to each of adjacent pairs of sleeves in an arrangement whereby said pilings function as the legs of the assembly, and wherein each of said pilings has an exterior surface area otherwise completely exposed to the environmental forces of tide, wind, waves and current, along substantially the entire length of each piling, each of said sleeves including means for introducing grout into the annular space between the inner surface of each sleeve and the outer surface of the piling extending therethrough in order to cement or secure the sleeve and piling together, sealing means at the upper and lower portion of each of said sleeves in order to retain the grout in the interior of the sleeve, the sealing means being an inflatable packer, each of said pilings including a flood valve at the lower end thereof in order to flood the interior of the piling thereby sinking the assembly to the submerged floor, and a reach rod within each piling connected to said flood valve and accessible at the upper end of the piling for actuating and removing the flood valve if desired. Means are provided to space and retain the piling and surrounding spaced sleeve in fixed relation during fabrication and until the jacket or structure is submerged and set on bottom, whereupon the sleeves and piling are released from fixed relation so that the piling may be driven into the water covered area to secure the platform in position in the water covered area.

Other objects, advantages and features of the present invention are that the jacket of the present invention are simple in design and fabrication. The reduced surface area of the units creates less drag forces on the jacket and the reduction in mass decreases the amount of structural material necessary to construct the units as well as fabrication cost and installation charges. Minimum shear loads and bending movement at the mud line will also be realized. The cost of cathodic protection of the jacket will also be diminshed.

A particularly unique feature of the present invention is that the jacket of the present invention incudes at the time of fabrication as one of its structural component pilings which hertofore have been supplemental to the conventional jacket legs of prior art systems. Thus, previous systems employed elongated jacket legs whereas in the embodiments of the present invention the pilings are provided instead of the massive and cumbersome jacket legs of systems of the prior art. Thus, the present invention eliminates old practices of driving foundation piles through the central bore of jacket legs in favor of driving them through a series of longitudinally aligned, spaced jacket sleeves.

Since an offshore jacket made of steel may weigh in excess of 1,500 tons, it can be seen that any reduction in the overall mass of such structure would be greatly beneficial and such reduction can be achieved with the concepts presented herein. Such reduction has been found to be effective in providing jacket assemblies with improved environmental stability in the unstable conditions in which such assemblies are employed.

BRIEF DESCRIPTION OF THE DRAWINGS

FIG. 1 is a pictorial, schematic representation of an offshore submersible drilling and platform jacket assembly, or structure of the present invention resting on the marine floor;

FIG. 2 is a pictorial representation partly in cross-section of a portion of the assembly of FIG. 1 and illustrating one of the pilings and a manner of retaining the piling in position relative to the spaced sleeves as the structure is floated and submerged to the desired location and position on the submerged surface;

FIG. 3 is a view of a piling illustrating details of the flooding system while may be used with each of the pilings; and FIG. 4 is a pictorial representation partly in cross-section of one of the jacket sleeves of FIG. 1 showing a form of the packer and grouting arrangement for each sleeve.

DESCRIPTION OF THE PREFERRED EMBODIMENT

In FIG. 1 there will be seen one form of the offshore submersible drilling and production platform jacket of the present invention resting on the marine floor at the mud line. A portion of the jacket assembly referred to generally at 10 will be seen extending above the water level represented by the uppermost dotted line in FIG. 1 so a platform may be positioned thereon above the water level and the assembly extends into the water to rest on the submerged surface S. The jacket assembly 10 consists of a series of pilings P, two of which are shown in dotted line and while only two pilings are shown, it is understood that generally at least four are employed, and in other instances an many as 16 or more may be used depending upon the platform size and use of the system. Above the water level, provision is made to add piling to the jacket 10 as the piles are driven into the submerged surface S and this will be seen as a piling add on section 13. The pile sections are welded to the upper end of the piles that extend through the longitudinally aligned, spaced jacket sleeves 15.

A system of internal bracing is shown generally at 17 as interconnecting the jacket sleeves 15 to maintain them in position and to form the platform of any suitable longitudinal extent and size. The bracing includes top horizontal brace shown at 14 and the lower horizontal brace at 16 extending between adjacent jacket sleeves. If desired horizontal braces could extend between the intermediate jacket sleeves 15 as well as the upper and lower jacket sleeves. Vetical bracing **16*a* may extend between diagonal bracing 16*b* and adjacent the piling as shown in FIG. 1. Horizontal bracing 14, 16 vertical bracing 16*a* and diagonal bracing 16*b* is tied in to the jacket sleeves 15 in any suitable manner to form joints 18 at the jacket sleeves 15 as shown. Thus, the jacket sleeves 15 together with the bracing 17 form a framework and a piling P is inserted into each group of aligned, spaced jacket sleeves 15 of the framework at the time of fabrication. The diagonal bracing 16*b*** is shown as connected at its ends between adjacent longitudinally spaced sleeves throughout the extent of the jacket assembly.

The sleeves 15 receive therethrough the pilings P so that the piling can be driven downwardly into the marine floor once the system is placed on location. It is to be noted that between the longitudinally aligned, spaced jacket sleeves 15 is an exposed section or portion 35 of each piling P, and that these exposed sections 35 are of a diameter less than the diameter of the sleeves 15 which diameter is that of the piling.

Once the jacket assembly 10 has been fabricated, moved to location and set on the marine floor and the pilings P driven into the ocean bottom, grout is pumped into each of the sleeves 15 via separate grout inlet lines 32 adjacent each group of jacket sleeves, as seen in FIGS. 1 and 4. In FIG. 1, a separate grout line is illustrated as positioned adjacent piling P and connected separately to each sleeve 15 associated with each piling P. More particularly, a separate grout line communicates with the seals, or packers on each sleeve. As shown in FIG. 1, the grout lines 32 each extend from above the water surface and each line is connected to the upper and lower packers 33, 34 on each sleeve in any suitable manner. The manner of connecting each grout ine 32 with each sleeve 15 is illustrated diagramatically in FIG. 4 wherein the grout line 32 is connected to the intermediate sleeve. Each packer 33, 34 on each sleeve is provided with a one-way opening check valve means represented schematically at **33*a* and 34*a*. The grout from line 32 enters packers 33, 34 and inflates them to seal off the annulus between sleeve 15 and the piling extending therethrough. When the pressure in packers 33, 34 exceeds a predetermined amount above inflation and sealing pressure, valves 33*a*, 34*a* open and the grout flows to annular void 31*a* to fill it and the packers remain set. A check valve represented schematically at 15*a* is associated with an opening 15*b* on each sleeve 15 to enable water to be displaced from void 31*a*** as it is filled with grout.

Similarly, grout lines 32 are provided for each jacket sleeves 15 between the uppermost and lowermost jacket sleeves 15. Packers 33 and 34 are arranged adjacent the end of each sleeve 15 and communicate with their respective grout lines and are provided with valve means as above described for actuation of the packers and filling of the void. Each jacket sleeve is also provided with means to enable the water to be enactuated from void 31*a* as it is filled with grout as described above with regard to FIG. 4. The jacket sleeve 15 that are above water may be supplied with grout from a line connected to a tender vessel, if desired. It is to be noted that the lowermost sleeve 15 is provided with a packer 34 within the void between sleeve 15 and the piling 11 there shown, for a purpose as will be described.

FIG. 2 shows the detail of the support system for each piling, one of which is represented at 11, relative to the longitudinally spaced sleeves 15 through which it extends and this will be seen to include a cover plate 25 having a vent valve 20 therein. Tie down or spacer plates 19 of any suitable form are circumferentially spaced and extend between each piling and the sleeve 15 at the upper end of each piling. The spacers 19 are secured by welds 19*a* to the piling and by welds 19*b* to the sleeves and these welds are burned off when it is desired to drive the piling into the ocean floor or surface S. The lower end of each piling is further supported by lowermost jacket sleeve 21 which includes a plurality of piling holding member 23. The holding members 23 include a shoulder 23*a* which abuts the lower ned of the piling as shown and also include a portion 23*b* which extends longitudinally of the lowermost jacket sleeve 21. The members 23 are secured by welds to the piling. The holding members 23 and spacers 19 secure and maintain the piling and surrounding sleeves in position during fabrication and movement of the assembly to an offshore location. Packer 34 is arranged between piling 11 and lowermost sleeve 21 as previously discribed so as not to interfere with holding members 23. FIG. 3 illustrates the piling flooding system which is actuated when it is desired to sink the jacket to the ocean floors. A valve actuator 26 is connected to the flood valve 28 located on cap 29 and the actuator 26 is protected by sleeve 24. Reach rod 27 extends downwardly from actuator 26 to the flood valve 28. A rupture pulling line is also provided at 30 and is accessible through the top cover plate 25 and connected at its lower end to lower internal closure cap 29 to remove the cap 29 and valve 28 when desired.

The assembly is positioned on the floor S in a water covered area by opening valves 28 in each piling 11 to floor the pilings in a manner well known to submerge and position the framework or structure. The pilings are then ready to be driven through the sleeves, and piling sections 13 added as required.

As noted previously, the welds 19*a*, 19*b* are burned off to disconnect the piling from its surrounding sleeve assembly, and the members 23, being connected with the piling move downwardly as the piling is driven into ocean floor S.

In FIG. 1 it should be noted that in prior art devices, longitudinally extending jacket legs were used to construct the offshore framework and that these legs extended longitudinally to form the jacket assembly. The bracing which, with the legs formed the jacket assembly was connected to such legs to form joints at longitudinally spaced intervals. The pilings were driven down through such legs into the ocean floor. These legs were of about the same diameter as the sleeves of the present invention and since they extended the entire length of the assembly from top to bottom it can be easily understood that the legs added considerable weight and cost to the assembly in comparison to the sleeves of the present invention. Thus, in FIG. 1, the legs covered up those exposed sections of piling indicated at 35. Hence, in the present invention exposed sections 35 represent areas of the jacket 10 where mass have been eliminated and areas where less surface area is present than has previously existed in the prior art. Such reduction in mass and surface area provides the device of the present invention with the advantages enumerated above.

While the drawings indicate only a single length of piling, it is to be understood that each piling P may be formed of a plurality of sections welded together during fabrication and other sections 13 of piling may be added as needed dependent upon each local and said conditions have been such as to require as much as 200 feet of soil depth penetration.

The foregoing disclosure and description of the invention are illustrative and explanatory, thereof, and various changes in size, shape and materials as well as in the details of the illustrated construction may be made without departing from the spirit of the invention.

What is claimed is:

1. A submersible offshore jacket assembly conprising:

a plurality of elongated pilings having a first diameter;

a plurality of sleeves of a diameter greater than said first diameter and associated with each piling in surrounding relationship thereto;

said plurality of sleeves being aligned longitudinally on said plurality of pilings; said longitudinally aligned plurality of sleeves being spaced longitudinally from the next adjacent longitudinally aligned plurality of sleeves on said plurality of pilings;

top horizontal braces secured to and extending between said uppermost plurality of longitudinally aligned sleeves on said plurality of pilings;

bottom horizonal braces secured to and extending between said lowermost plurality of longitudinally aligned sleeves on said plurality of pilings;

a diagonal brace arrangement between the longitudinally spaced plurality of longitudinally aligned sleeves from said top to said bottom horizontal brace, said diagonal brace arrangement being formed by each of said plurality of longitudinally aligned sleeves having a diagonal brace secured thereto and extending diagonally to and secured with one of said sleeves of the next adjacent, longitudinally aligned plurality of sleeves on said plurality of pilings;

vertical braces adjacent and extending parallel to each of said plurality of pilings and secured to one of said diagonal braces extending between adjacent, longitudinally aligned and longitudinally spaced sleeves;

each of said plurality of pilings including a flood valve at the lower end thereof for flooding the interior of each of said plurality of pilings to thereby sink the assembly to the bottom of a submerged surface;

a reach rod within each of plurality of said pilings connected to said flood valve and accessible at the upper end of each of said pilings for actuating and de-actuating said flood valve; and means to introduce grout into each of said sleeves to secure said plurality of longitudinally spaced sleeves in position along said pilings in longitudinal spaced relation, said means including:

upper and lower seal means adjacent the upper and lower end, respectively, of each of said sleeves for sealing with said elongated piling extending therethrough; and means for communicating grout to said upper and lower seal means of each of said sleeves and to the annulus between each of said sleeves and said piling extending therethrough for sealing each of said sleeves with said respective piling which is surrounds.

* * * * *